US007308815B2

(12) United States Patent
Chen

(10) Patent No.: US 7,308,815 B2
(45) Date of Patent: Dec. 18, 2007

(54) TERMINAL CRIMPING PLIERS

(75) Inventor: Ching-Jen Chen, Taipei Hsien (TW)

(73) Assignee: Pin-Ruei Industrial Co., Ltd., Taipei Hsien (TW)

( * ) Notice: Subject to any disclaimer, the term of this patent is extended or adjusted under 35 U.S.C. 154(b) by 59 days.

(21) Appl. No.: 11/335,535

(22) Filed: Jan. 20, 2006

(65) Prior Publication Data

US 2007/0169531 A1 Jul. 26, 2007

(51) Int. Cl.
*H01R 43/042* (2006.01)

(52) U.S. Cl. ..... 72/409.14; 29/751; 29/566.4; 7/107

(58) Field of Classification Search ..... 72/409.14, 72/409.16, 416; 29/751, 750, 566.4; 7/107; 81/9.4

See application file for complete search history.

(56) References Cited

U.S. PATENT DOCUMENTS

| | | | | |
|---|---|---|---|---|
| 3,594,887 | A | 7/1971 | Over | 29/56.6 |
| 4,480,374 | A | 11/1984 | Meyer | 29/566.4 |
| 5,168,592 | A | 12/1992 | Jee | 7/107 |
| 6,612,147 | B2 | 9/2003 | Beetz et al. | 72/409.16 |
| 6,968,726 | B2 | 11/2005 | Wang | 72/409.14 |
| 2006/0107726 | A1 | 5/2006 | Heggemann et al. | 72/409.14 |

*Primary Examiner*—Daniel C Crane
(74) *Attorney, Agent, or Firm*—Rabin & Berdo, P.C.

(57) ABSTRACT

A terminal crimping pliers is provided, which is designed with a simple structure, and is used to improve the disadvantages of the conventional terminal crimping pliers, such as being difficult to be grasped and difficult for forces applied thereon. The terminal crimping pliers can be extended with a small angle, through a vertical stopping slot combined with two stopping slots with oblique angles, and the terminal crimping pliers can be held closed with a small force.

3 Claims, 7 Drawing Sheets

TERMINAL CRIMPING PLIERS

BACKGROUND OF THE INVENTION

1. Field of Invention

The present invention relates to a pliers exclusively used for manufacturing, assembling, maintaining or repairing line connectors, or current collectors, and more particularly, to a terminal crimping pliers for clamping a terminal tab with electrical connecting lines, which is much easier to be grasped and to be applied with forces thereon.

2. Related Art

The terminal crimping pliers connects a terminal and electrical connecting lines by way of clamping, thereby producing an electrical conduction. There are various kinds of conventional terminal crimping pliers, from early crimping pliers with a single function to current crimping pliers with multiple functions, such that a user can select suitable pliers optionally. The structural design of the terminal crimping pliers mainly utilizes the lever principle, such that the terminal crimping pliers can be clamped or released through the grasping or relaxing action of the user's palm. The clamping force is used to combine the terminal tab with the electrical connecting lines. Referring to FIG. 1, it shows a conventional terminal crimping pliers 10, wherein two opposing handles 101, 102 are pivotally disposed with a first pivot 103, such that the handles 101, 102 can be clamped or opened via the first pivot 103. Also, the top of the handle 101 is pivotally disposed at a assembly board 107 with a second pivot 104, whereas the handle 102 is pivotally disposed in a stopping slot 1051 of the assembly board 107 through a locating bar 105, such that the moving distance of the whole terminal crimping pliers 10 is limited by the stopping slot 1051. Furthermore, the top of the handle 101 is provided with a collet 106, which can protrude within a crimping hole 1071; for example, as shown in the figure, when the terminal crimping pliers 10 is open, the locating bar 105 is located at the most right part of the stopping slot 1051; when the handles 101, 102 are forced to be tightly grasped, the locating bar 105 will move towards left along the stopping slot 1051, and when the locating bar 105 reaches the most left part of the stopping slot 1051, the whole terminal crimping pliers 10 is clamped completely, with the collet 106 at the top of the handle 101 being completely protruded. Such a clamping action is utilized by the user to combine a terminal tab with a plurality of electrical connecting lines. However, the structure of such a conventional terminal crimping pliers has a disadvantage in that, since the opening distance enables the collet 106 to return to the bottom, such that a terminal tab (not shown) can be conveniently inserted into the crimping hole 1071 above the collet 106, when the two handles 101, 102 are opened completely, and the angle is usually too large (as the stopping slot 1051 of the locating bar 105 is at horizontal position and the distance is too long), it is difficult for the user with small palms to grasp it completely. In this way, to hold the two handles 101, 102 closed, a problem of it being difficult to apply forces thereon occurs. That is, the user needs to grasp the handles with two hands to achieve the complete clamping (protruding) of the collet 106; otherwise, although it can be almost grasped, problems of improperly applying forces or applying inadequate forces will occur during clamping. Therefore, how to reduce the angle generated at the opening of two handles, to be suitable for the palms of each user, is the technical means to be disclosed in the present invention.

SUMMARY OF THE INVENTION

In view of the above problems, an object of the present invention is to provide a terminal crimping pliers, being easy to be held closed and easy to be applied with forces, thereby reducing the inconvenience of operation effectively. The structure of the stopping slot is improved, such that the horizontal moving distance of the locating bar is reduced, and accordingly the opening angle for the two handles will not be too large, and it is convenient for the user to operate.

In the terminal crimping pliers of the present invention, two handles are pivotally disposed with a pivot, and a locating bar is disposed at the top of the two handles respectively. The pivot and the two locating bars are received within each stopping slot respectively, and their moving distance is limited by each stopping slot, wherein the stopping slots for the two locating bars are leaned at an angle towards upward, such that the whole left/right moving distance in the horizontal direction is reduced, and therefore, the opening angle between the two handles is reduced, which is more suitable for operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
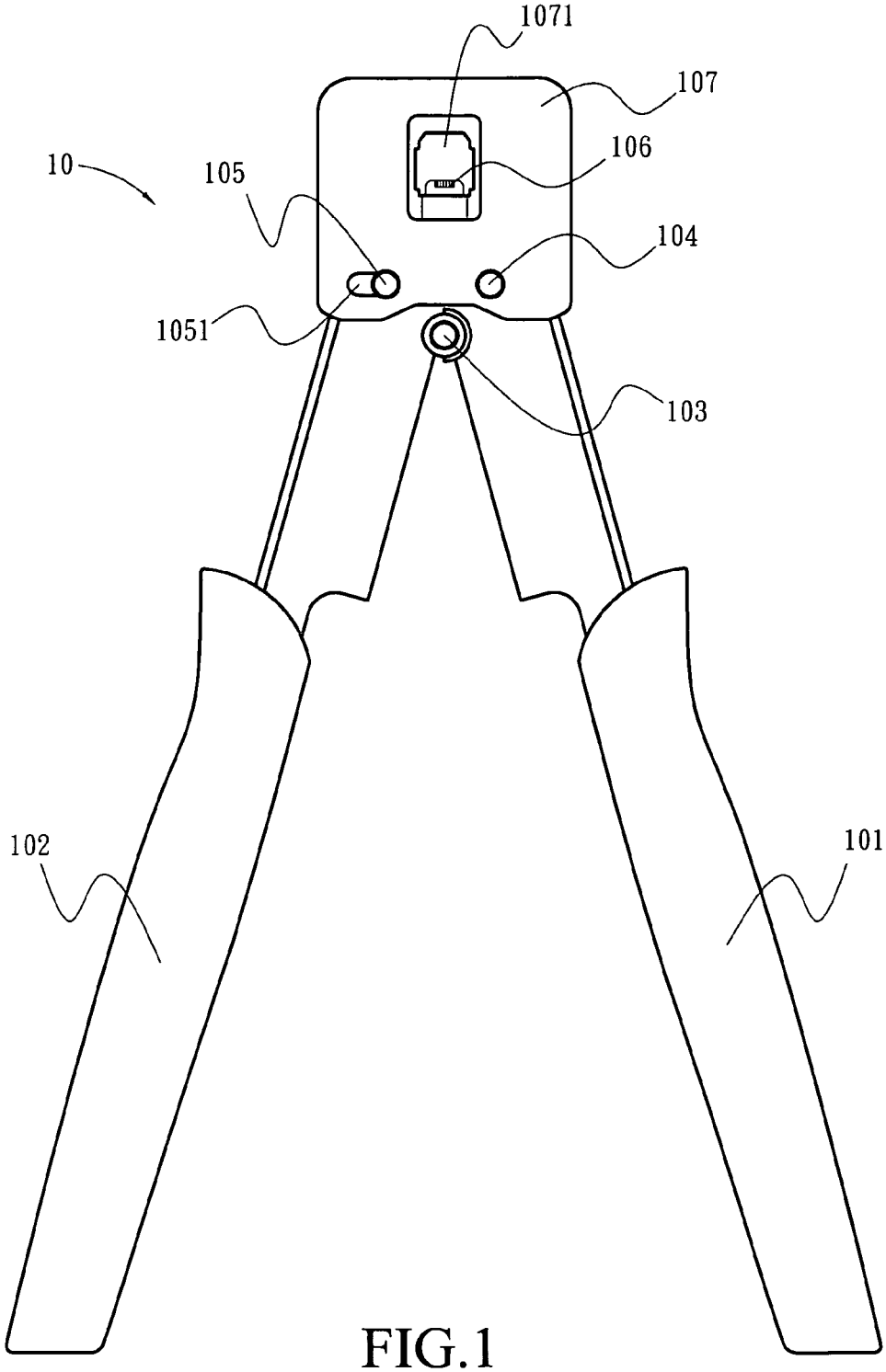
FIG.1 (PRIOR ART)
FIG. 1 is a conventional terminal crimping pliers.
Figure 2:
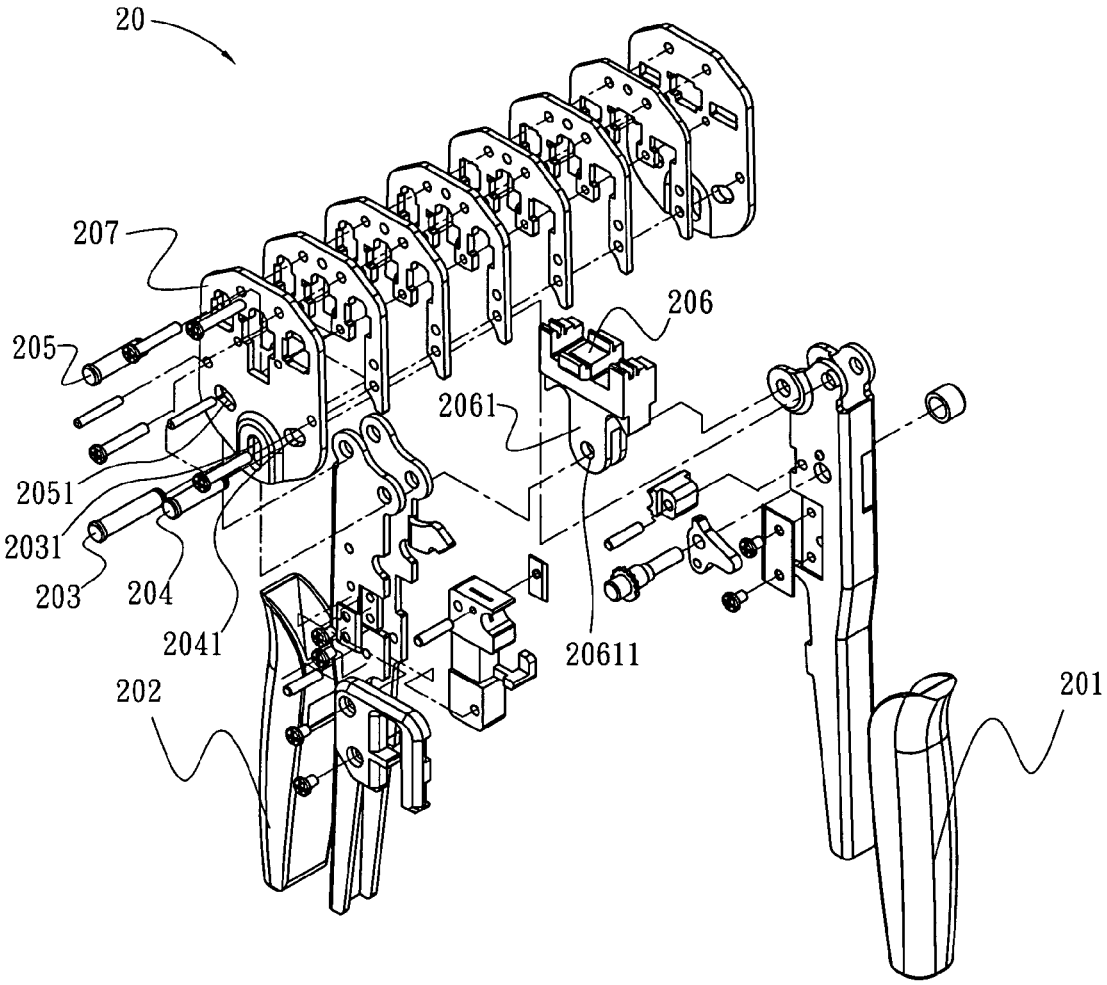
FIG. 2 is a schematic view of the assembly of the present invention.

Referring to FIG. 2, it is a schematic view of the assembly of the present invention. As shown in the figure, as for the terminal crimping pliers 200 of the present invention, two opposing handles 201, 202 are pivotally disposed in a first stopping slot 2031 of an assembly board 207 through a pivot 203, and then the two opposing handles 201, 202 can be oppositely opened or closed. As shown, a first locating bar 204 and a second locating bar 205 are disposed adjacent to the top of the first stopping slot 2031, wherein the first locating bar 204 and the second locating bar 205 can pass through the handles 201, 202 via a second stopping slot 2041 and a third stopping slot 2051 of the assembly board 207. As shown, the assembly procedure for each element is that, the pivot 203, the first locating bar 204, and the second locating bar 205 pass through each stopping slot (the first stopping slot 2031, the second stopping slot 2041; and the third stopping slot 2051) of the assembly board 207; as shown, the pivot 203 passes through the first stopping slot 2031 of the assembly board 207; the first locating bar 204 passes through the second stopping slot 2041 of the assembly board 207; and the second locating bar 205 passes through the third stopping slot 2051 of the assembly board 207; after passing through the first stopping slot 2031, the pivot 203 then passes through the handles 201, 202, such that the two handles 201, 202 are pivotally disposed. The pivot 203 can move up and down within the first stopping slot 2031. Also, the end of the pivot 203 then passes through an interlocking post 2061 at the bottom of a collet 206, wherein the collet 206 and the interlocking post 2061 are integrated as a whole, with a general T-shape. At the bottom of the interlocking post 2061, a through hole 20611 is provided for being passed by the pivot 203. After passing through the second stopping slot 2041 and the third stopping slot 2051, the first locating bar 204 and the second locating bar 205 can move back and forth within the distance defined by the second stopping slot 2041 and the third stopping slot 2051. Thus, each element has been assembled, as shown in FIG. 3.

Figure 3:
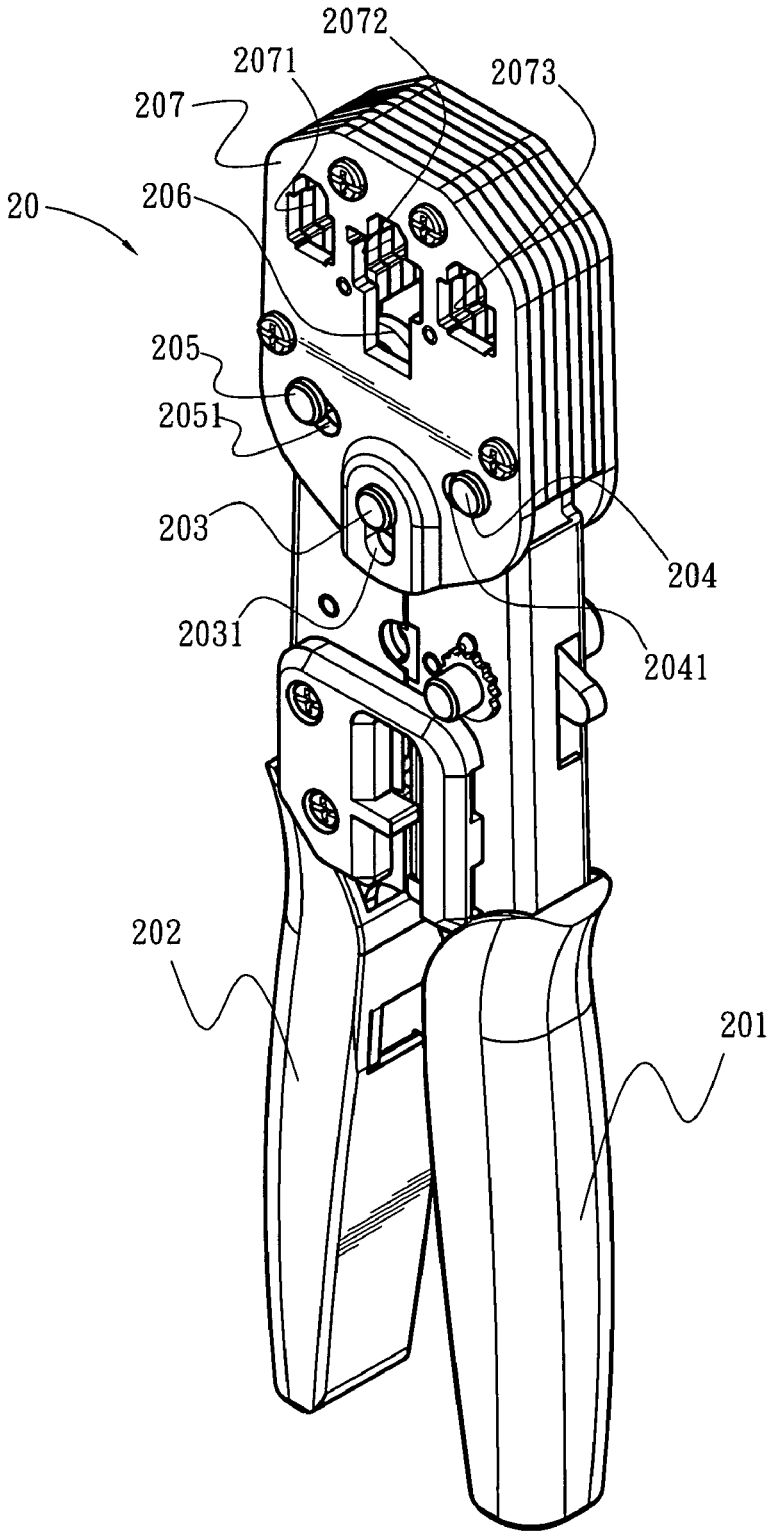
FIG. 3 is a stereogram view of a terminal crimping pliers of the present invention.

Referring to FIG. 3, it is a stereogram view after the present invention has been assembled. As shown in the figure, the assembly board 207 is provided with a plurality of crimping holes (as shown by 2071, 2072, 2073), wherein the several crimping holes (2071, 2072, 2073) are used to accommodate a terminal tab and electrical connecting lines (not shown) for carrying out a crimping operation, such that the collet 206 is closely adjacent to the bottom of each crimping hole (2071, 2072, 2073), and during the crimping operation, the collet 206 can carry out the operations of propping-up and releasing in each crimping hole (2071, 2072, 2073).

Figure 4:
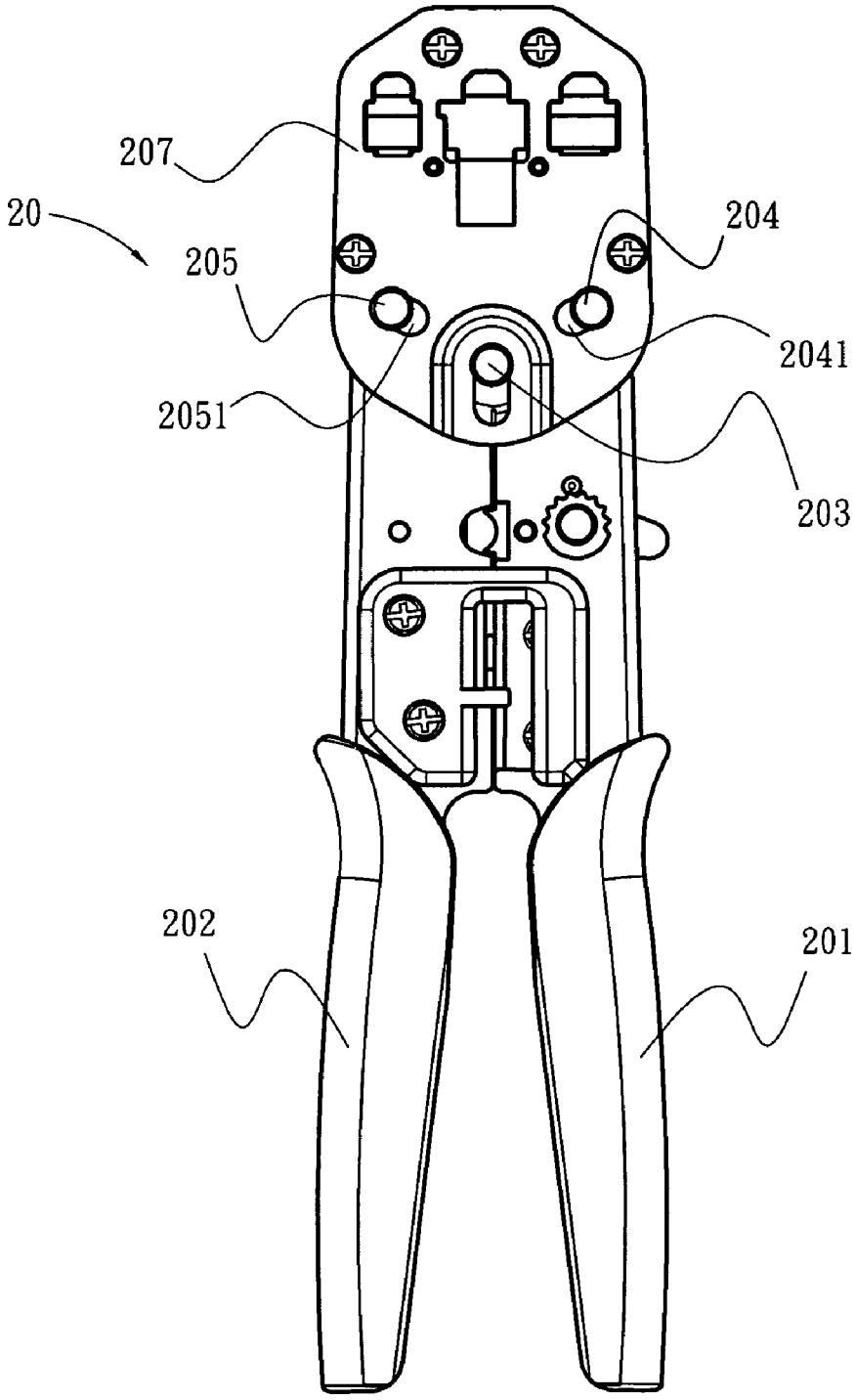
FIG. 4 is an embodiment when the terminal crimping pliers of the present invention is held closed.
Figure 5:
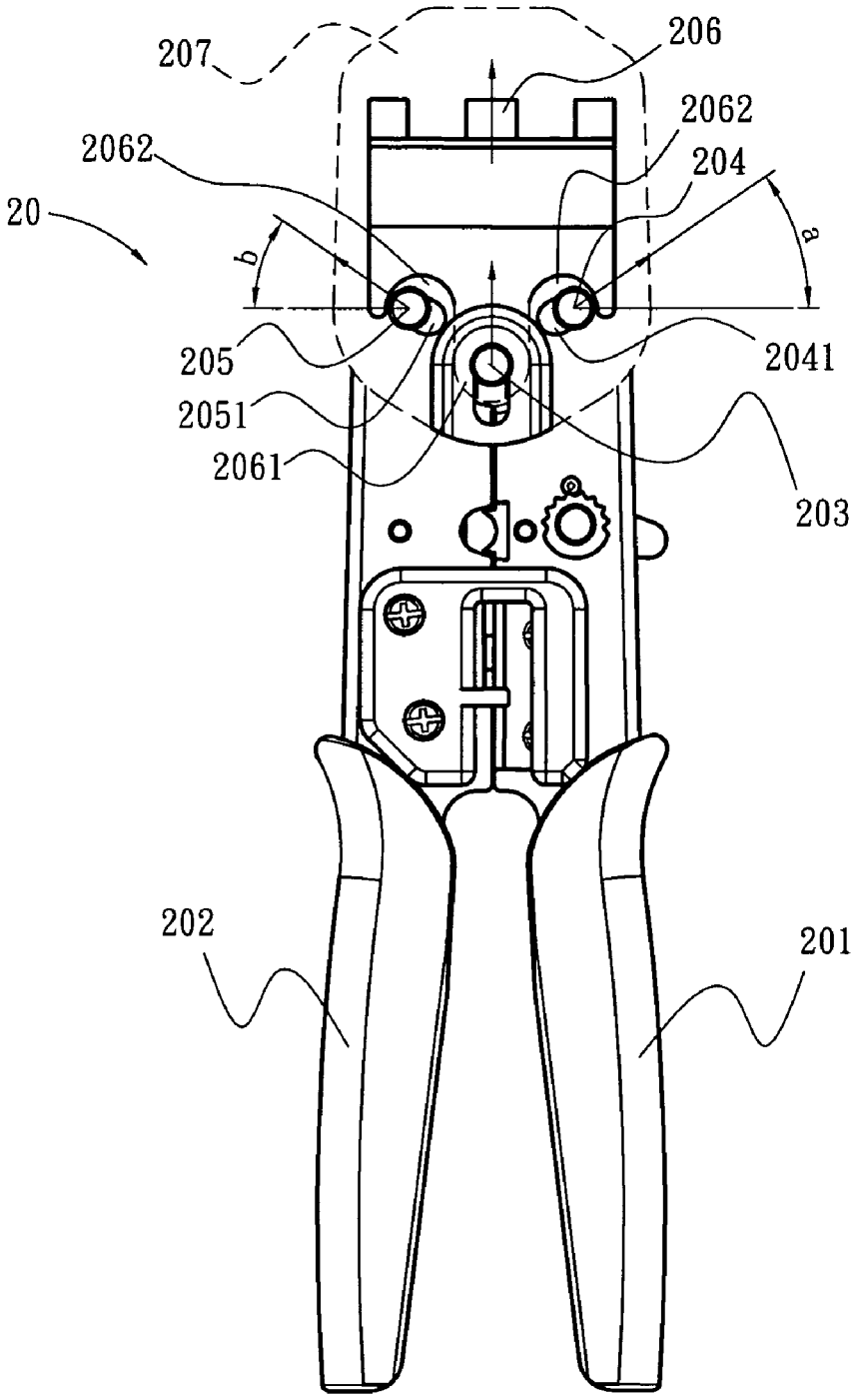
FIG. 5 is a plan perspective view when the terminal crimping pliers of the present invention is held closed.

Referring to FIG. 4, the first stopping slot 2031 is formed at a vertical axial direction, as shown in the figure, such that the pivot 203 can move up and down within the first stopping slot 2031, while the second stopping slot 2041 and the third stopping slot 2051 are formed at an axial direction leaned towards upward with a proper angle respectively (such as, angles a, b shown in FIG. 5). In this way, the first locating bar 204 and the second locating bar 205 can move back and forth within the second stopping slot 2041 and the third stopping slot 2051 with oblique angles. Referring to FIG. 5, when forces are applied upon the two opposing handles 201, 202 to hold them closed, the first locating bar 204 and the second locating bar 205 can move within the second stopping slot 2041 and the third stopping slot 2051, that is, when the handles 201, 202 are forced to produce a relative movement, the first locating bar 204 and the second locating bar 205 are associately moved. As shown in the figure, when the first locating bar 204 and the second locating bar 205 are moving, the collet 206 is interlocked to move upwards, since the connection slots 2062 at both sides of the interlocking post 2061 are interlocked due to the moving upwards of the pivot 203 and also the movement (oppositely opening) of the first locating bar 204 and the second locating bar 205. Therefore, the user can apply a force easily to protrude and push the collet 206 upwards, achieving the clamping of the terminal tab and the electrical connecting lines.

Figure 6:
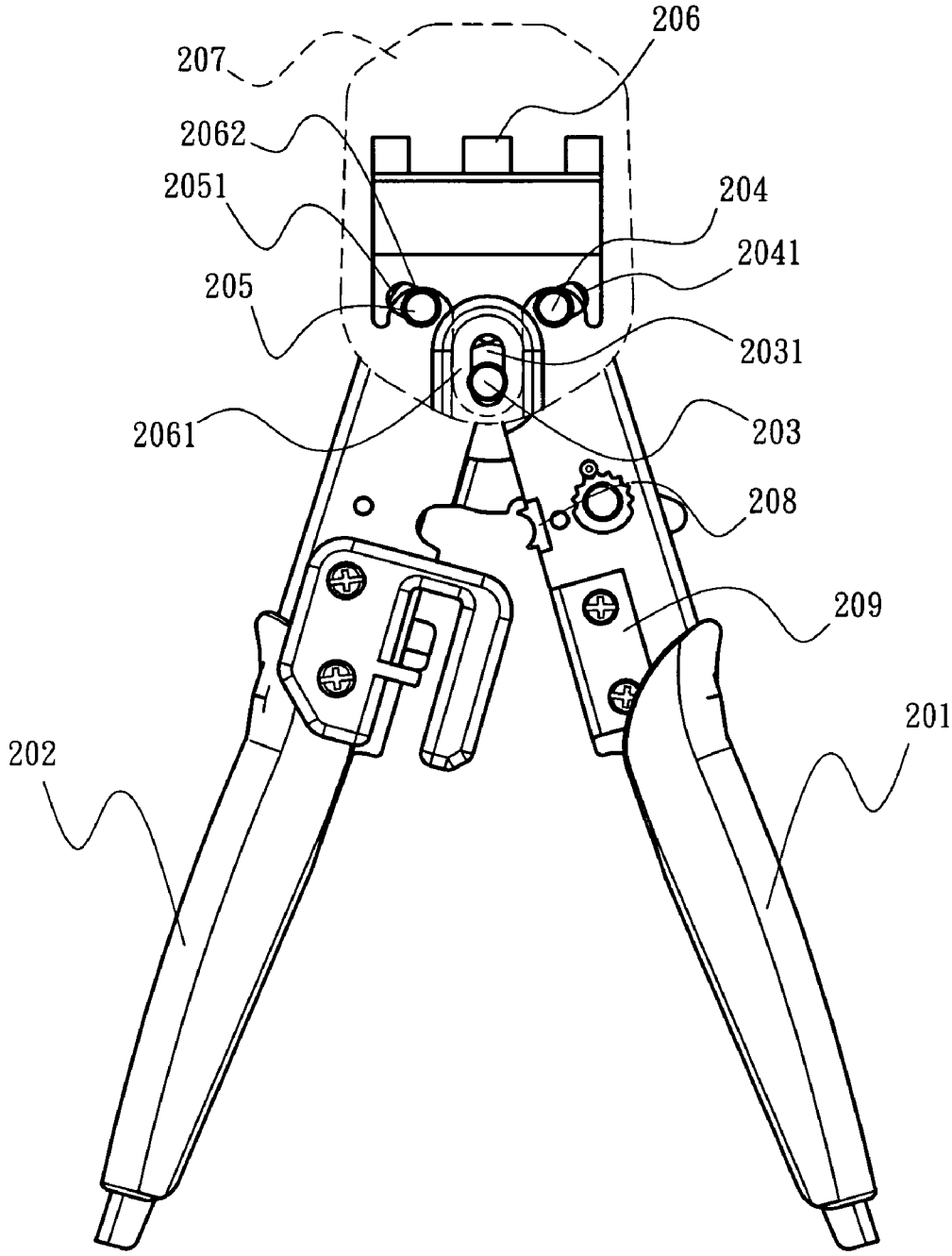
FIG. 6 is a plan perspective view when the terminal crimping pliers of the present invention is opened.

Referring to FIG. 6, it is an embodiment when the two handles 201, 202 of the terminal crimping pliers 20 of the present invention are opened. As shown in the figure, when the two opposing handles 201, 202 are opened, the position of the pivot 203 lowers vertically, while the first locating bar 204 and the second locating bar 205 move towards the bottom within the second stopping slot 2041 and the third stopping slot 2051 respectively. When the pivot 203 is lowered, the interlocking post 2061 of the collet 206 is interlocked to move downwards, and accordingly, the collet 206 will be interlocked to move downwards, that is, the releasing mode for the collet 206. Back to the figure, at the releasing mode for the collet 206, the first locating bar 204 and the second locating bar 205 are located within the connection slots 2062 at both sides of the interlocking post 2061, wherein the connection slot 2062 is of an arc shape, such that the first locating bar 204 and the second locating bar 205 can move smoothly along the arc-shaped track.

Figure 7:
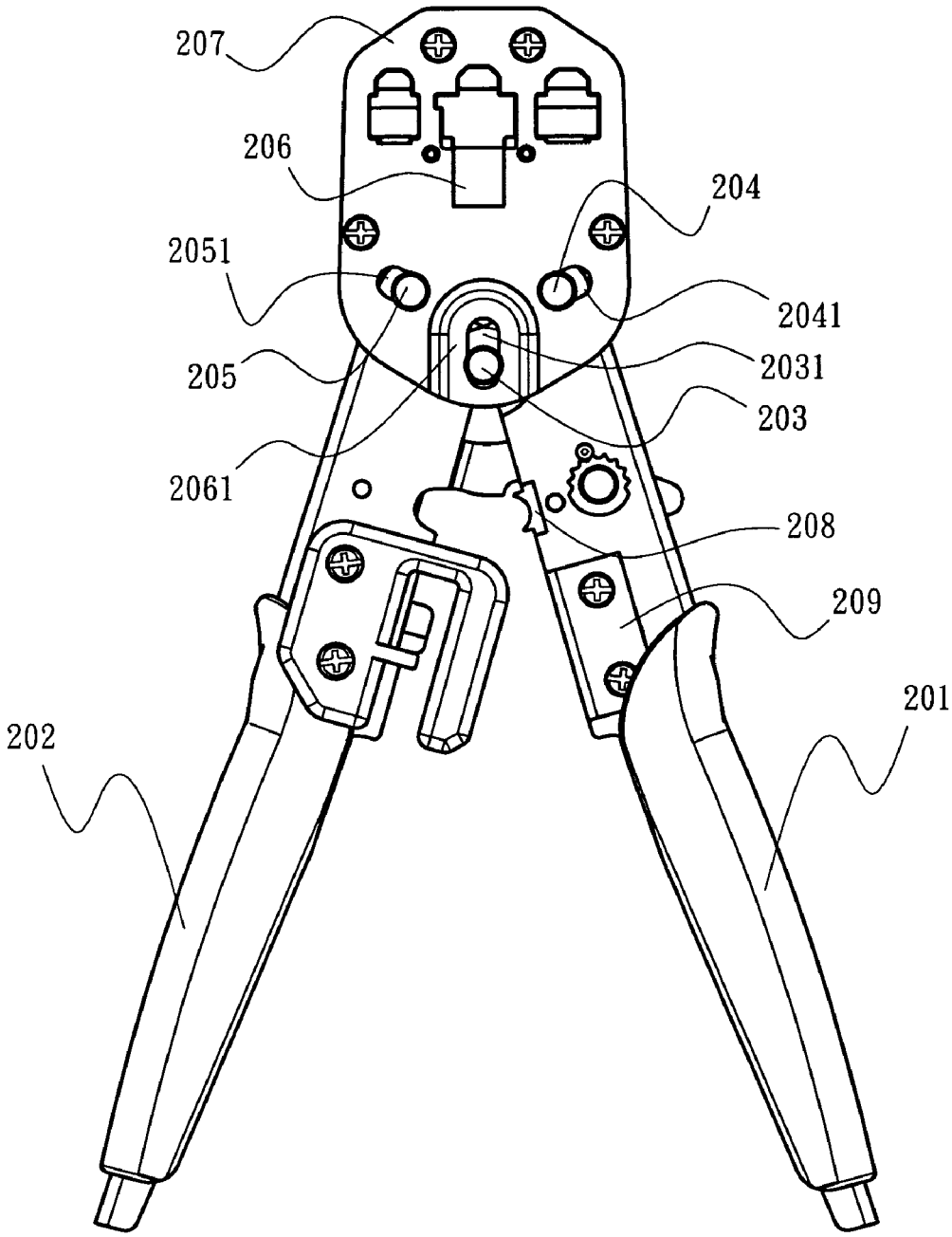
FIG. 7 is an embodiment when the terminal crimping pliers of the present invention is opened.

When the two opposing handles 201, 202 are opened to a maximum limit, as shown in FIG. 7, the pivot 203 is located at the bottom of the first stopping slot 2031, and the two locating bars 204, 205 are located at the bottom of the second stopping slot 2041 and the third stopping slot 2051 respectively.

As can be known from the above, the terminal crimping pliers of the present invention utilizes the lever principle, such that the forces applied to the terminal crimping pliers are significantly reduced. The present invention is characterized in that, two locating bars are interlocked with the collet at the same time, and the second stopping slot 2041 and the third stopping slot 2051, used for limiting the two locating bars, are leaned at a proper angle respectively, and therefore, the relative distance of the opening and the closing of the two handles 201, 202 may be reduced, and it is easy for the user to grasp, thereby relieving the inconvenience of operation.

To provide the terminal crimping pliers with multiple functions, a skinning knife 208 can be provided on the handles 201, 202 respectively, for peeling off the electrically insulting sheath outside the electrical connecting line, or a cut-off knife 209 can be provided, for cutting off the electrical connecting line.

In summary, after the terminal crimping pliers of the present invention is implemented, the object of being easy to grasp and to apply forces, thereby reducing the inconvenience of operation, can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A terminal crimping pliers, for clamping a terminal tab with a plurality of electrical connecting lines, comprising;

two opposing handles;

a pivot passing through and pivotally connecting the two handles;

an assembly board having a plurality of crimping holes and two stopping slots;

a collet provided at the bottom of the crimping holes and interlocked with the pivot, such that the collet moves back and forth within the crimping holes, and thus the collet and the crimping holes are clamped or released, and the two opposing handles are interlocked with the collet; and a first locating bar and a second locating bar, the first locating bar passing through a top of one of the two opposing handles and one of the two stopping slots, the second locating bar passing through a top of the other handle and the other stopping slot, the two locating bars moving back and forth within a distance according to opening or closing of the two opposing handles, wherein the two stopping slots are formed at an axial direction leaned upward defining an imaginary V-shape having a mouth at the widest opening of the V such that each stopping slot forms an upward oblique angle with a horizontal line that extends from an inside to an outside of the assembly board and with the mouth of the V-shape facing the plurality of crimping holes, said two stopping slots limiting movement of the first and second locating bars within the two slots, thereby reducing the distance for the opening and the closing of the two opposing handles.

2. The terminal crimping pliers as claimed in claim 1, wherein one of the two opposing handles is provided with a skinning knife, for peeling off an external insulting sheath of the electrical connecting lines.

3. The terminal crimping pliers as claimed in claim 1, wherein one of the two opposing handles is provided with a cut-off knife for cutting off the electrical connecting lines.

* * * * *